United States Patent [19]

Jans

[11] Patent Number: 4,575,137

[45] Date of Patent: Mar. 11, 1986

[54] LATCH MECHANISM AND LOCKING ADAPTOR

[75] Inventor: Franz W. Jans, Offenbach, Fed. Rep. of Germany

[73] Assignee: Jans & Heinsdorf GmbH, Offenbach, Fed. Rep. of Germany

[21] Appl. No.: 516,967

[22] Filed: Jul. 25, 1983

[51] Int. Cl.[4] ..... E05C 1/16

[52] U.S. Cl. ..... 292/169.14; 292/337

[58] Field of Search ..... 292/169.14, 169.16, 292/244, 150, 169.15, 169.17, 169.18, 337; 70/481, 483

[56] References Cited

U.S. PATENT DOCUMENTS

| | | | |
|---|---|---|---|
| 1,701,994 | 2/1929 | Wilson | 292/169.18 |
| 2,593,573 | 4/1952 | Kulbersh | 292/169.18 X |
| 2,871,047 | 1/1959 | North et al. | 292/169.17 X |
| 3,257,136 | 6/1966 | Russell et al. | 292/244 |

*Primary Examiner*—Richard E. Moore

*Attorney, Agent, or Firm*—Harris Zimmerman; Howard Cohen

[57] ABSTRACT

A door latch mechanism includes a housing having a bolt extending outwardly therefrom, and a split sleeve extending through the housing and disposed to drive adjacent cams concentric with the sleeve to operate a retractor to retract the bolt against a biasing spring. The split sleeve receives a split spindle of a door knob assembly to rotate the sleeve and retract the bolt. A locking adapter includes a generally cylindrical housing having a chordal slot for receiving the latch housing therethrough. The cylindrical housing includes aligned apertures through which the spindle extends. A locking cam is secured in one aperture, and a lock release cam is secured in the other aperture. A lock shaft extends through the housing parallel to the axis of the apertures, and includes a boss for engaging and blocking the locking cam to lock the spindle, and a protrusion engagable by the release cam to drive the lock shaft axially to release engagement of the boss and the locking cam. The adapter is joinable to the latch housing to permit locking of the latch mechanism from either side thereof, and the lock is released by rotation of the knob on the locking side.

8 Claims, 12 Drawing Figures

LATCH MECHANISM AND LOCKING ADAPTOR

BACKGROUND OF THE INVENTION

The following United States patents comprise the closest known prior art:

U.S. Pat. Nos. 2,662,388; 2,723,874; 2,800,347; 3,425,247; 4,142,748; 4,143,529.

It is well known in the prior art to provide a door latch mechanism comprising a bolt extending therefrom to engage a strike and latch the door closed, the bolt being retractable to disengage the strike and permit opening of the door. Generally, such devices include a retractor which is driven by a cam rotatable by the spindle of a knob or handle assembly. The retractor acts against the resilient bias of a compression spring which maintains the bolt in the extended position.

Often it is desirable to provide such door latch mechanisms with a privacy lock to prevent opening of the door from one side thereof. This feature is attained by including a button or knob extending from one of the rosettes of the latch mechanism. The button or knob operates a shaft or the like which is actuable to lock the latch mechanism from the one side of the door which is provided with the button.

Due to the fact that doors may be hung in either left hand or right hand opening fashion, and that the privacy feature may be desirable on either side of such doors, it is necessary to manufacture prior art latch mechanisms with privacy locks so that they may be used in any combination of these parameters. As a result, it is necessary to manufacture and stock a large number of differing latch mechanisms and privacy lock mechanisms, causing higher costs to the manufacturers and consumers.

SUMMARY OF THE PRESENT INVENTION

The present invention generally comprises a door latch mechanism which may be used in conjunction with either left hand or right hand opening doors, and an adapter assembly selectively employed in conjunction with the latch mechanism to impart a privacy lock feature to either side of the door. The adapter is secured about the latch mechanism within the door in reversible fashion, so that right or left hand opening doors may be accommodated with no alteration of the mechanism. Thus the latch mechanism and the adapter of the present invention can replace the wide number of latch assemblies and locking assemblies now required to accommodate the various combinations of door opening configurations and privacy locks.

The door latch mechanism includes a housing having a bolt extending outwardly therefrom to engage a strike, and a split sleeve extending through the housing and disposed to drive adjacent cams concentric with the sleeve to operate a retractor to retract the bolt against a biasing spring. The split sleeve receives a split spindle of a door knob assembly to rotate the sleeve and retract the bolt. The locking adapter includes a generally cylindrical housing having a chordal slot for receiving the latch housing therethrough. The cylindrical housing includes aligned apertures through which the door knob spindle extends. A locking cam is secured in one aperture, and a lock release cam is secured in the other aperture.

A lock shaft extends through the housing parallel to the axis of the apertures, and includes a boss for engaging and blocking the locking cam to lock the spindle, and a protrusion engagable by the release cam to drive the lock shaft axially to release engagement of the boss and the locking cam. The adapter is joinable to the latch housing to permit locking of the latch mechanism from either side thereof, and the lock is released by rotation of the knob on the lockable side to rotate the respective half of the split spindle and operate the respective one of the adjacent cams to drive the retractor and retract the bolt.

DESCRIPTION OF THE PREFERRED EMBODIMENT

The present invention generally comprises a door latch mechanism and an adapter assembly which is joinable to the latch mechanism to provide thereto a privacy lock feature. A salient aspect of the present invention is that the latch mechanism may be used in left or right hand opening doors, and that the adapter assembly may be joined to the latch mechanism in either left or right hand disposition to provide the privacy lock feature in either application and to either side of the door. Furthermore, the lock may be released by mere actuation of the door latch handle on the side which includes the privacy lock, so that an individual cannot inadvertently be locked in or out of a room.

Figure 1:
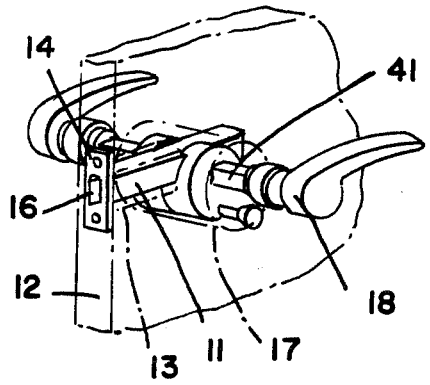
FIG. 1 is a perspective view of the latch mechanism and adapter assembly of the present invention, shown installed in a door.

With regard to FIG. 1, the present invention includes a latch mechanism 11 adapted to be received in a slot formed in the edge of a door 12, as is known in the prior art. The latch mechanism includes an outer face plate 14 through which a latch bolt 16 extends to engage a strike plate on the door jamb. In the construction industry it is now a common practice to manufacture doors having a slot 13 preformed therein to receive a standard size latch mechanism, and a hole 17 bored through the door and the inner end of the slot 13 and spaced inwardly from the edge 12 a standard distance to accommodate the latch handle-spindle assembly 18 therethrough. A common arrangement provides a bore of 2 inches or $2\frac{1}{4}$ inches diameter which is spaced inwardly $2\frac{1}{4}$ inches from the edge 12.

Figure 2:
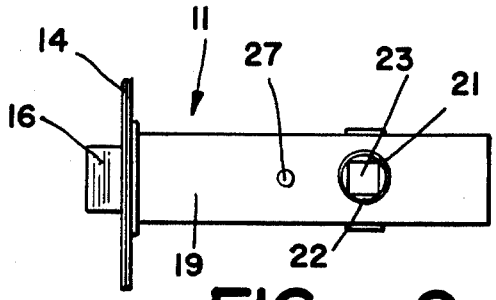
FIG. 2 is a side elevation of the latch mechanism of the present invention.
Figure 3:
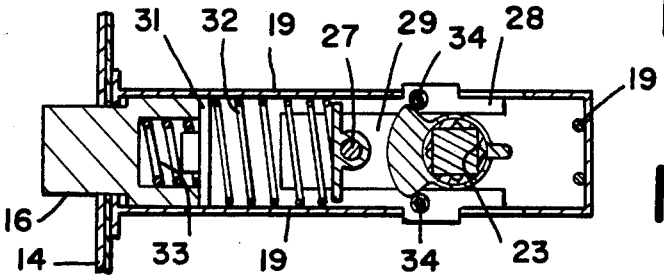
FIG. 3 is a horizontal cross-sectional view of the latch mechanism of the present invention.
Figure 4:
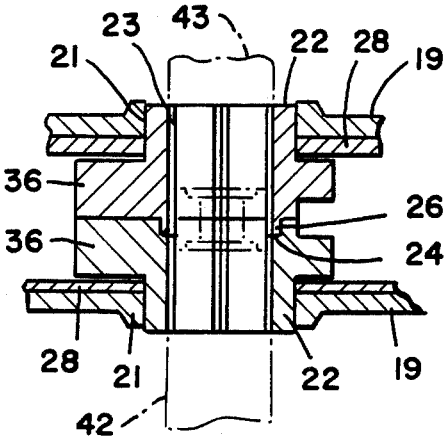
FIG. 4 is a top view of the split spindle and twin retractor cam assembly of the latch mechanism of the present invention.

As shown in FIG. 2, the latch mechanism 11 includes a generally rectangular housing 19 with the face plate 14 joined rigidly to one end thereof. Adjacent to the other end a pair of annular protrusions 21 extend outwardly from the opposed sides of the housing 19. With reference also to FIG. 4, the latch mechanism includes a pair of generally cylindrical sleeve members 22 which are journalled in the protrusions 21 in rotatable fashion. A square shaft hole 23 extends axially through the sleeve members 22 to receive a spindle, as will be explained in the following. It is important to note that one of the sleeve members includes an inner face having an annular recess 24 formed therein, and the other sleeve member includes an annular protrusion 26 extending from the confronting inner face thereof to engage the recess 24. This engagement assures continued registration of the sleeve members with respect to the axis of the shaft hole and the annular protrusions 21, and also permits the sleeve members each to rotate individually with respect to the other about the axis of the shaft hole.

Extending through the housing 19 from one side to the other is a post 27. Disposed within the housing 19 is a retractor frame 28 which is disposed for reciprocal translation within the housing. The frame 28 is generally rectangular, and is provided with a longitudinal slot 29 which permits clearance of the post 27 and the sleeve members 22 during translation. The distal end of the frame 28 supports a plate 31. A helical compression spring 32 is secured between the plate 31 and the post 27 to resiliently bias the retractor frame distally toward the bolt 16. Disposed between the inner end of the bolt 16 and the plate 31 is a secondary compression spring 33 having a lower spring constant than the spring 32.

Figure 5:
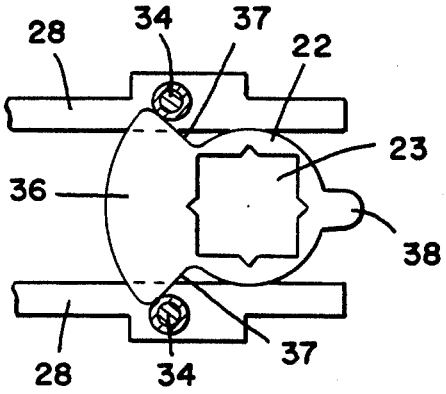
FIG. 5 is a side elevation of the twin retractor cam and retractor assembly of the latch mechanism, shown in the extended position.

It should be noted that the retractor frame 28 includes a pair of side members disposed adjacent to the laterally opposed sides of the housing 19. Extending between the sides of the retractor frame are a pair of cam follower rods 34 spaced above and below the sleeve members 22. Each of the sleeve members 22 is provided with a cam lobe 36 extending radially outwardly therefrom and disposed to engage either of the cam follower rods 34, as shown in FIG. 5. The cam lobes 36 are generally aligned in adjacent, colinear fashion when the shaft holes 23 extending through the sleeve members 22 are properly aligned in registration. Each of the cam lobes 36 includes camming surfaces at angularly opposed edges thereof. The camming surfaces describe an angular separation of approximately 90 degrees. Extending radially outwardly from each of the sleeve members 22 is a stop lug 38 which is diametrically opposed from the medial portion of the respective cam lobe.

Figure 11:
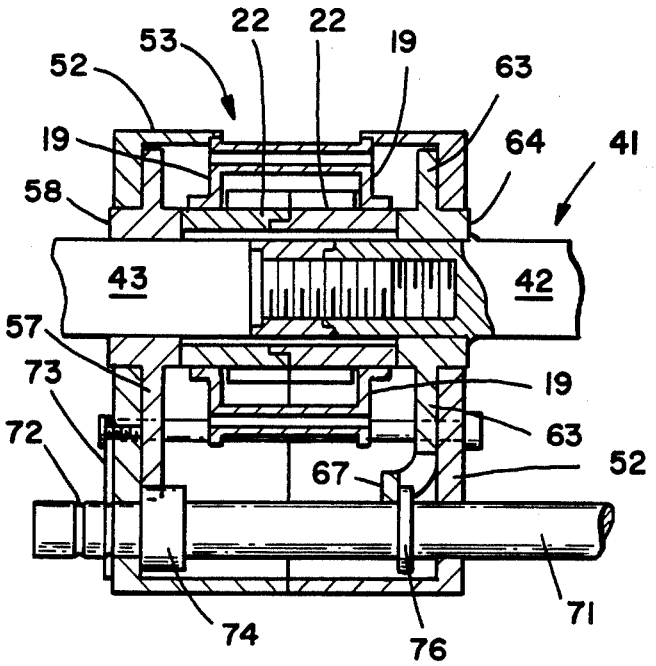
FIG. 11 is a cross-sectional elevation of the latch mechanism and the adapter assembly, shown in the locked position.

With regard to FIGS. 4 and 11, the door handle assembly 18 is provided with a spindle 41 which has a generally square cross-sectional configuration adapted to be received in the shaft holes 23 of the sleeve members 22. It is significant that the spindle is comprised of two square shaft members 42 and 43 which are threadedly joined at a medial portion of their assembly. Each of the members 42 and 43 is rotatable with respect to the other, and each is also engaged in its respective sleeve member 22. Thus each shaft member 42 or 43 is capable of rotating its respective sleeve member without effecting rotation of the other sleeve member.

Figure 6:
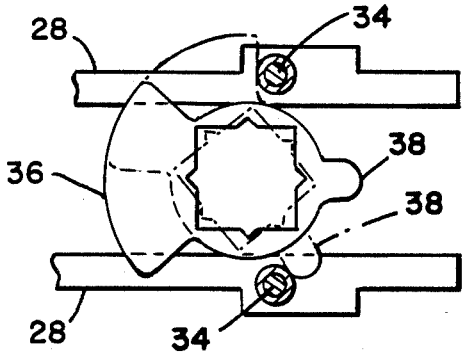
FIG. 6 is a side elevation as in FIG. 4, shown in the retracted position.
Figure 7:
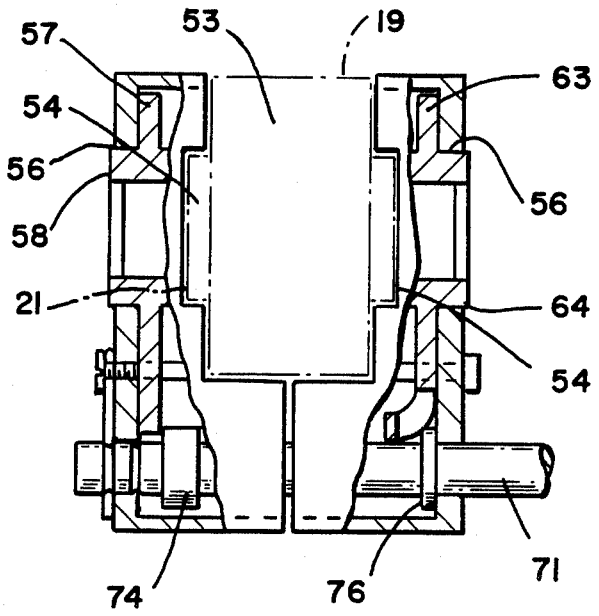
FIG. 7 is a cross-sectional end view of the adapter assembly of the present invention.
Figure 8:
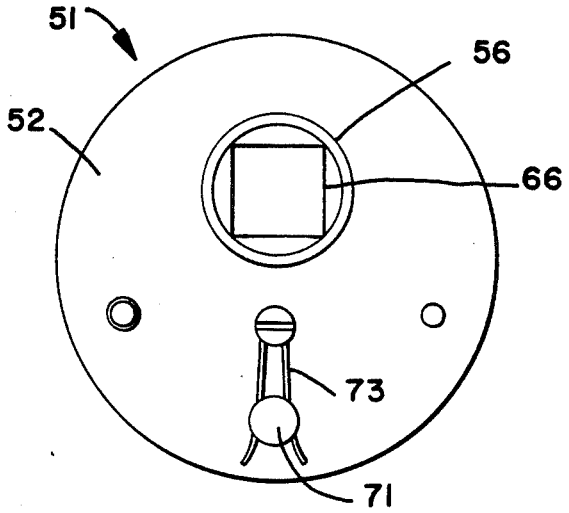
FIG. 8 is a side elevation of the adapter assembly of the present invention.

As shown in FIG. 6, either of the sleeve members 22 may be rotated by its respective shaft member 42 or 43 to cause the respective cam lobe 36 to engage one of the cam followers 34. Rotation of either sleeve in either direction will cause one of the cam surfaces 37 to engage one of the followers 34. Continued rotation will drive the retractor frame away from the face plate, and cause retraction of the bolt 16 from the strike of the latch to open the door 12. It should be noted that the cam rotation is limited by the stop lug 38, which will engage the other cam follower after a shaft rotation of less than 90 degrees. Thus either handle of the handle assembly 18 may be employed to rotate the spindle 41 to release the latch.

The latch mechanism 11 described in the foregoing is a basic latch mechanism which may be used in a wide variety of application in which a locking feature is not needed or desired. When it is required or desired that a latch mechanism with a locking feature be installed, the adapter assembly of the present invention may be assembled to the latch mechanism to add a privacy lock function to either side of the latch.

The adapter assembly 51 of the present invention includes a generally cylindrical housing 52 which is generally hollow within. A slot 53 extends through the housing 52 in chordal fashion, and is dimensioned in width to receive the housing 19 of the latch mechanism 11 therein. The slot 53 also includes enlarged width portions 54 which accommodate the annular protrusions 21 of the housing 19. The housing is provided with a pair of holes 56 extending through opposed ends thereof and aligned on an axis which is eccentric with respect to the axis of symmetry of the housing. The holes 56 are disposed to be aligned with the annular protrusions 21 of the housing 19, so that the spindle 41 may extend through the assembled latch and adapter assembly. This alignment is effected when the housing 19 is inserted into either end of the slot 53.

The adapter assembly 51 includes a locking cam member 57 which is disposed adjacent to one end of the housing 52. The cam member includes a protruding annulus 58 adapted to be received in one of the holes 56 in rotatable fashion. A square hole 59 extends axially through the annulus to engage the square spindle 41 so that the cam member 57 rotates in common with the respective shaft member 42 or 43 extending therethrough. The cam member 57 includes an arcuate upper edge 61 which is disposed to clear the inner walls of the housing 52 during rotation, and a generally rectangular lower portion which is dimensioned to undergo an angular excursion of approximately +45 degrees without impinging on the inner walls of the housing. Disposed in the lower edge of the cam member 57 is a shallow recess 62.

The adapter assembly 51 also includes a lock release cam member 63 disposed adjacent to the other end of the housing 52 and in opposition to the cam member 57. The release cam 63 includes a protruding annulus 64 adapted to be secured in the other hole 56 in rotatable fashion. A square hole 66 extends axially through the annulus 64 to engage the square spindle 41 so that the release cam member 63 rotates in common with the respective shaft member 42 or 43 extending therethrough. The cam member 63 is provided with the same general shape as the member 57, and indeed may be fabricated from the same sheet metal blank. A major distinction, however, is that the lower end of the release cam member is provided with an interior die cut to define a lower lip 67 expanded arcuately outwardly from the plane of the cam member.

A lock shaft 71 extends through the opposed ends of the housing 52 parallel to the axis of the holes 56. The lock shaft includes an annular detent groove 72 adjacent to one end thereof, and a detent clip 73 is secured to the adjacent outer end surface of the housing to engage the groove 72 to selectively position the shaft 71. Within the housing an enlarged diameter shoulder 74 is secured to the shaft 71 adjacent to inner end surface of the housing and also adjacent to the detent groove 72. The shoulder 74 is dimensioned to be engaged in the shallow recess 62 of the locking cam 57. This engagement prevents rotation of the locking cam member and effectively prevents rotation of the respective shaft member 43 extending through the hole 59 thereof (FIG. 11). That is, the member 74 engaged in the recess 63 prevents actuation of the latch mechanism from the side of the latch mechanism on which it is mounted by preventing rotation of the handle spindle portion extending therethrough.

Figure 10:
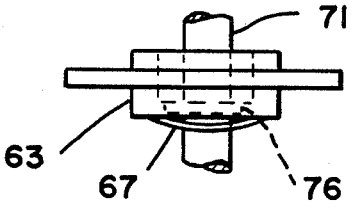
FIG. 10 is a top view of the release cam engagement of the locking shaft of the adapter assembly.
Figure 12:
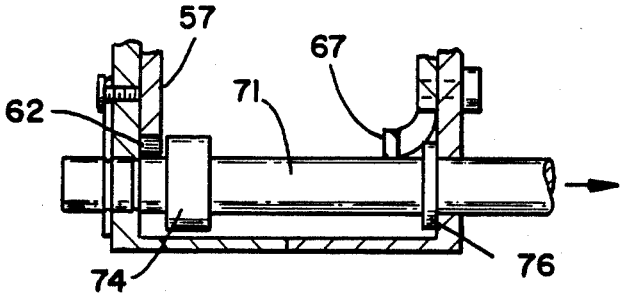
FIG. 12 is a partial cross-sectional elevation of the locking shaft and the adapter assembly cams, shown in the unlocked position.
Figure 9:
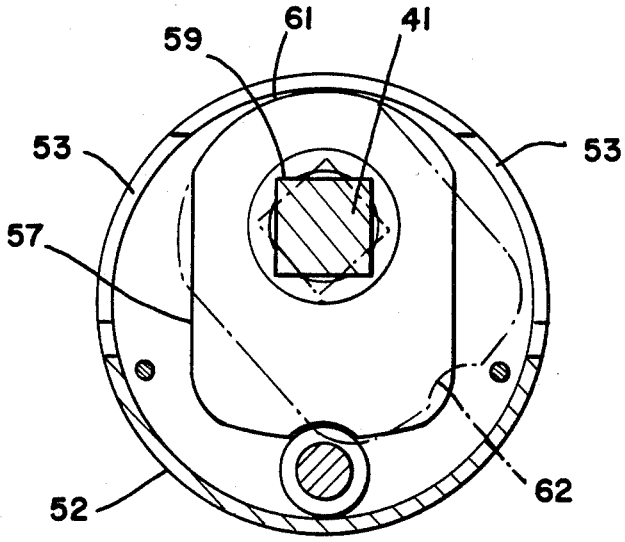
FIG. 9 is an enlarged cross-sectional side elevation of the locking cam of the adapter assembly.

The lock shaft also includes an enlarged diameter ring 76 extending therefrom adjacent to the other inner end of the housing. The ring 76 is disposed within the confines of the expanded lip 67 of the release cam member 63, as shown in FIGS. 10–12. When the respective shaft member 42 is rotated, the release cam member 63 is rotated therewith. This action causes the lip 67 to engage the ring 76. Due to the arcuate nature of the lip 67, it drives the ring 76 and the shaft 71 in the axial direction shown in FIG. 12. The axial translation of the shaft 71 disengages the shoulder 74 from the recess 62, thus releasing the lock effect created thereby. The shaft 71 may be driven axially until the clip 73 engages the annular groove 72 in the lock shaft.

It may be appreciated that the lock shaft 71 extends outwardly from the housing 52 through the rosette of the latch mechanism adjacent thereto. This side of the door is thus provided with a privacy lock feature which is actuated by manually pushing the lock shaft 71 inwardly. The shoulder 74 thus engages the recess 62 of the locking cam, thus immobilizing the shaft member 43 extending outwardly to the other side of the door. To release the lock, the outer end of the shaft 71 may be pulled outwardly to release the locking cam. However, the lock may be released more easily by rotation of the handle adjacent to the outer end of the shaft 71. This action rotates the shaft member 42, causing the release cam member to engage the ring 76 to drive the shaft 71 axially and release the shoulder 74 from engagement with the lock cam 57. At the same time, this rotation of the shaft 42 causes the sleeve member 22 through which it extends to rotate in common therewith, thus rotating the respective cam 36 and operating the retractor frame 28. That is, rotation of the handle not only releases the lock, it also effects opening of the latch mechanism. It is therefor impossible for an individual to inadvertently be locked into or out of a room.

I claim:

1. A door latch mechanism, including a housing, a latch bolt supported in said housing in translatable fashion and adapted to extend outwardly from one end of said housing, a split sleeve assembly extending through said housing, said split sleeve assembly including a pair of sleeve members having aligned openings extending therethrough, a handle assembly including a handle spindle, said spindle extending through said aligned openings of said split sleeve assembly, each of said sleeve members including a retractor cam extending radially therefrom, a retractor frame slidably disposed in said housing and joined to said bolt, cam follower means extending from said retractor frame and disposed to be engaged by either of said retractor cams to translatably withdraw said bolt into said housing, spring means for biasing said bolt to extend outwardly of said housing, said spindle of said handle assembly comprising a pair of shaft members joined end to end in rotatable fashion, each of said shaft members being received in a respective one of said sleeve members for independent actuation thereof, an adapter assembly for said door latch mechanism secured about a portion of said housing and including means to selectively lock said door latch mechanism, said adapter assembly including an adapter housing, a slot extending through said adapter housing to receive said portion of said door latch housing therethrough, said adapter assembly including a pair of holes extending therethrough and disposed in registration with said aligned openings of said split sleeve assembly of the latch housing received in said slot, said adapter assembly further including a locking cam member rotatably secured in one of said holes, one of said spindle shaft members extending through and engaging said locking cam member for rotation in common therewith, and means for releasably engaging said locking cam member to prevent rotation of said one of said spindle shaft members extending therethrough and thus prevent retraction of said bolt, thereby locking said door latch mechanism.

2. The door latch mechanism of claim 1, said last mentioned means including a lock shaft extending through said adapter assembly housing, and means on said lock shaft for engaging said locking cam to block rotation of said locking cam and said one of said spindle shaft members extending therethrough.

3. The door latch mechanism of claim 2, wherein said adapter assembly further includes a release cam member rotatably secured in the other of said holes, the other of said spindle shaft members extending through and engaging said release cam member for rotation in common therewith.

4. The door latch mechanism of claim 3, further including means on said lock shaft for engaging said release cam member and for driving said lock shaft axially to effect release of engagement of said locking cam member and said lock shaft and to unblock rotation of said one of said spindle shaft members.

5. The door latch mechanism of claim 2, further including a portion of said lock shaft extending outwardly of said adapter assembly housing, and means at the distal end of said lock shaft portion for urging said lock shaft to translate axially to effect release of engagement of said locking cam member and said lock shaft and to unblock rotation of said one of said spindle shaft members.

6. The door latch mechanism of claim 2, wherein said means on said lock shaft for engaging said locking cam includes an enlarged diameter annulus extending from said lock shaft, said locking cam member including a recess for receiving and engaging said annulus.

7. The door latch mechanism of claim 4, wherein said means for engaging said release cam member includes a ring secured about said lock shaft, said release cam member including a camming surface disposed to drive said ring axially.

8. In combination with a door latch assembly which includes a housing, a bolt extendable from the housing, a mechanism in the housing for retracting the bolt, and a handle shaft extending from the housing and selectively rotatable to actuate the mechanism and retract the bolt, the improvement comprising:

a locking adapter for said door latch mechanism, removably secured about a portion of the housing and including means to selectively lock the door latch mechanism, said adapter assembly including an adapter housing, a slot extending through said adapter housing to receive the portion of said door latch housing therethrough, said adapter assembly including a pair of holes extending therethrough and disposed to receive the handle shaft therethrough, said adapter assembly further including a locking cam member rotatably secured in one of said holes, the handle shaft extending through and engaging said locking cam member for rotation in common therewith, and means for releasably engaging said locking cam member to prevent rotation of the handle shaft extending therethrough and thus prevent retraction of the bolt, thereby locking said door latch mechanism.

* * * * *